United States Patent [19]

Hamada

[11] Patent Number: 4,637,611

[45] Date of Patent: Jan. 20, 1987

[54] SLOT MACHINE WITH REEL POSITION DETECTOR

[75] Inventor: Norihiko Hamada, Tokyo, Japan

[73] Assignee: Kabushiki Kaisha Universal, Oyama, Japan

[21] Appl. No.: 338,497

[22] Filed: Jan. 11, 1982

[30] Foreign Application Priority Data

Jan. 12, 1981 [JP] Japan ..... 56-1762[U]
Apr. 27, 1981 [JP] Japan ..... 56-59868[U]

[51] Int. Cl.[4] ..... A63F 5/04
[52] U.S. Cl. ..... 273/143 R; 273/138 A
[58] Field of Search ..... 273/143 R, 138 A

[56] References Cited

U.S. PATENT DOCUMENTS 4,095,795 6/1978 Saxton et al. ..... 273/143 R
4,099,722 7/1978 Rodesch et al. ..... 273/143 R
4,299,388 11/1981 Resch et al. ..... 273/143 R

*Primary Examiner*—Richard C. Pinkham
*Assistant Examiner*—MaryAnn Stoll Lastova
*Attorney, Agent, or Firm*—Young & Thompson

[57] ABSTRACT

A slot machine having a plurality of reels each of which is provided with an annular row of symbols on its periphery and is driven and stopped by a pulse motor associated therewith. The position of the respective reel can be detected by the content of a counter which counts the pulse signals fed to the pulse motor during revolution of the reel, the counter being reset to zero photoelectrically at the same point in each revolution of the reel.

3 Claims, 3 Drawing Figures

SLOT MACHINE WITH REEL POSITION DETECTOR

BACKGROUND OF THE INVENTION

The present invention relates to a slot machine having a plurality of reels each provided with an annular series of various symbols, and more particularly relates to a slot machine in which a plurality of reels are driven by means of pulse motors or stepping motors.

The prior art in this field includes slot machines having a plurality of reels mounted individually rotatably on a common shaft, each reel having an annular series of various symbols such as pictures of a cherry, a bell, a bar, or characters or numerals such as "7" or the like on the peripheries of the respective reels at regular intervals. The reels are caused to rotate simultaneously by manipulation of an actuator handle after inserting coins or tokens in the machine. A plurality of latch means or stop levers associated with respective reels are automatically operated to stop the respective reels after mutually different periods of time predetermined by mechanical timers or upon the actuation of stop buttons associated with the respective reels. Upon the respective reels stopping at random during each game to display various combinations of symbols which are visible through a window provided in a housing of the machine, the machine detects predetermined prize-winning combinations of symbols to cause the pay out of different numbers of coins, tokens or the like.

In these known slot machines, there is the disadvantage that the machine is complicated in construction and/or noisy in operation, since the reels are caused to rotate and to stop in different positions by means of mechanical devices.

Furthermore, these machines have to be provided with means for detecting the stop positions of the respective reels in order to determine whether a predetermined prize-winning combination of symbols is displayed in the window, for the purpose of paying out coins. It is known to provide a mechanical stop-position-detecting device comprising a circular row of contacts corresponding to the number of symbols and brushes or an optical stop position detecting device comprising a circular row of holes bored through a disc rotatable together with the respective reel, corresponding to the number of symbols and photo-couplers, for generating coded signals corresponding to the actual stop positions. In such machines, however, there is the disadvantage that the stop position detecting devices are complicated due to the need to provide a large number of contacts and brushes or photo-electric devices. In the case of the contact-brush arrangement, particularly, there is the great problem that the contact members soon undergo substantial wear and tear and so are poor in durability.

OBJECTS OF THE INVENTION

The principal object of the present invention is to provide a slot machine which is simple in constitution.

Another object of the present invention is to provide a slot machine in which the actual stop position of a respective reel can be detected by means of a simple device.

SUMMARY OF THE INVENTION

These and other objects of the present invention are achieved by using pulse motors by which the reels are rotated and stopped in different positions. The amount of angular movement of a reel is in proportion to the number of driving pulses fed to the pulse motor. Then the actual stopped position of a reel can be indicated by a pulse counter which is adapted to count pulse signals fed to the pulse motor after the previous content of the counter has been reset to zero by the detecting of a fixed point on the respective reel. As a result of this, the identity of one transverse row of symbols on the respective reels, which is displayed within the window of the machine, can be detected.

BRIEF DESCRIPTION OF THE DRAWINGS

Other objects, advantages and features of novelty of the invention will be evident to those skilled in the art from a reading of the following specification, taken in conjunction with the accompanying drawings, in which.

DETAILED DESCRIPTION OF THE INVENTION

Figure 1:
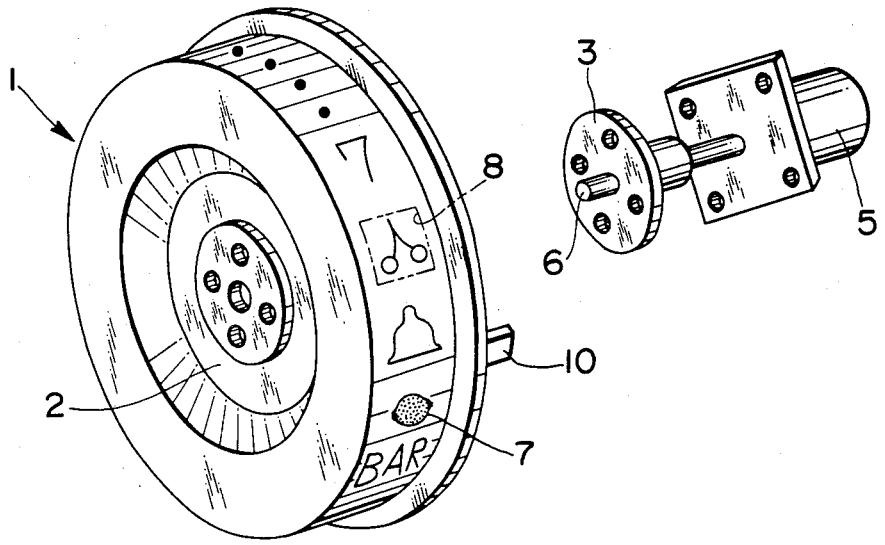
FIG. 1 is an exploded perspective view of a principal portion of a machine according to the present invention.

Referring now to the drawings in greater detail, wherein like reference numerals denote the same or similar elements throughout the several views, in a preferred embodiment illustrated in FIG. 1, there is schematically shown one of a plurality of reel assemblies which is comprised of a reel 1 having a dish-like recess 2 in one side thereof, a connecting plate 3 firmly secured to the bottom of the recess 2 by means of screws 4, and a pulse motor 5 on the shaft of which the connecting plate 3 is firmly secured so as to cause rotation of the reel 1 upon actuation of the pulse motor. On the peripheral surface of the reel 1, symbols such as pictures of bells, cherries, numerals or other signs in an annular series are provided at regular intervals. One symbol on the reel 1 is visible through a window 8 when the reel 1 stops, as is conventional in this art.

Figure 2:
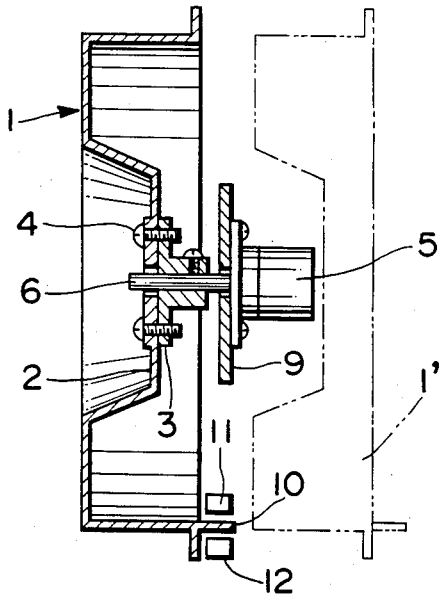
FIG. 2 is a partial cross-sectional view of a principal portion of a machine comprising a preferred embodiment of the present invention.

The pulse motor 5 is mounted on a frame member 9 disposed between two reels 1 and 1' as shown in FIG. 2. The slot machine has, as usual, three reels disposed coaxially in side-by-side arrangement. Each of these reels is caused to rotate individually by means of the pulse motor (only one of which is shown) associated therewith. These reels are started in rotation by means of a common start switch but stop in different positions, and after different periods of rotation, by means of individual stop switches. It is possible to stop the respective reels automatically by random timer circuits if desired.

For detecting the stopped positions of the reels, there is on each reel provided a light shield in the form of projection 10 projecting in the horizontal direction, that is, parallel to the axis of the reel. Projection 10 serves as a point of reference from which the amount of angular movement of the reel is measured. When the reel rotates, the light shield projection 10 passes repeatedly between a light emitting element 11 and a light receiving element 12 both of which are disposed at a fixed position.

Figure 3:
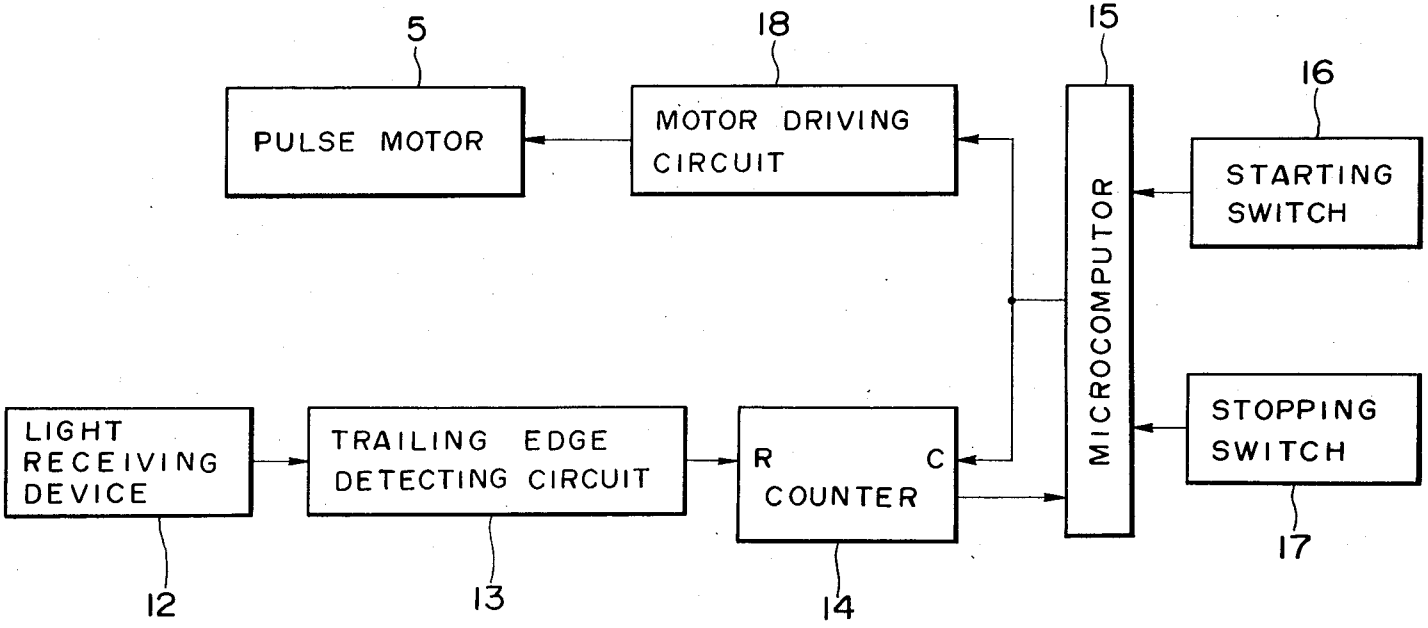
FIG. 3 is a schematic block diagram showing the electric circuitry of a machine comprising a preferred embodiment of the present invention.

FIG. 3 shows an electric circuit for controlling the rotation of a single reel, wherein the light receiving element 12 includes, for instance in this embodiment, a photo-diode to receive light from the light emitting element 11. When the light receiving element 12, the light shield projection 10 and the light emitting element 11 are aligned, the photo-current flowing through the light receiving element 12, i.e., the photodiode is lowered, since the light receiving element 12 is prevented from receiving light from the light emitting element 11.

The output signals from the light receiving element 12 are fed to a trailing edge detecting circuit 13 for detecting the trailing edge of the output signals. The trailing edge detecting circuit can be replaced by a leading edge detecting circuit for detecting a leading edge of the output signals. Upon detecting a trailing edge, the trailing edge detecting circuit 13 generates an output signal and feeds it to a reset terminal R of a counter 14 so as to reset the content thereof to zero. A microcomputer 15 continuously provides pulse signals for the period of time between actuation of a start switch 16 and actuation of a stop switch 17. The pulse signals are produced by an interruption operation so that the cycles of the pulse signals are gradually shortened to be fixed at a rated cycle after a specific time. It is to be noted that there may be provided a pulse generator for generating the desired pulse signals under the control of the microcomputer 15.

The pulse signals from the microcomputer 15 are then fed to a motor driving circuit to rotate the pulse motor 5 and are simultaneously fed to the counter 14 to be counted. Since the previous content of the counter 14 is reset at the same point in every revolution of the reel 1, the stopped position of the reel is directly indicated by the content of the counter 14. The pulse signals may be counted by the microcomputer 15 having a logic circuit and a memory in programmed operation, without using the counter 14. In this case the logic circuit adds "1" (one) to the previously memorized data in the memory (RAM) for each output pulse signal from the microcomputer 15 and then deposits the new data again in the memory. Upon receipt of a signal from the trailing edge detecting circuit 13, the data written in the memory are returned to zero.

But regardless of whether the counter 14 or a RAM is used, the operation is generically referred to herein as "counting".

When the stop switch 17 is operated to prevent the microcomputer 15 from providing further pulse signals, the reel is brought to a stop rapidly and then the content of the counter 14 is memorized by the microcomputer 15. The content of the counter 14 indicates the symbol which is displayed in the window because the order of symbols arranged on the reel 1 is previously known. Therefore, one transverse combination of symbols on the respective reels in the stopped position is indicated by the counters associated with the respective reels. The microcomputer has memorized the information as to predetermined prize-winning combinations of symbols and the numbers of coins or tokens to be awarded corresponding to each of predetermined prize-winning combinations of symbols. So the microcomputer compares the transverse combination of symbols occurring on the respective reels in the stopped position, with the predetermined prize-winning combinations memorized therein, so as to determine the number of coins or tokens, if any, to be paid out and to control any desired one of the coin dispensing mechanisms well known in this art to cause release of the number of coins determined.

What is claimed is:

1. A slot machine having a plurality of reels each of which has an annular series of symbols on the peripheral surface thereof at regular intervals, comprising:

pulse motors one individual to each said reel for driving the associated said reels;

means for generating and emitting a series of pulse signals, motor driving means receiving said pulse signals and causing said pulse motors to rotate by one step for every received pulse signal;

means for detecting a predetermined point on each said reel once every revolution thereof; and means to count said pulse signals and to reset to zero its previous contents by a signal from said predetermined point detecting means for detecting the stopped positions of said reels according to the number of said counted pulse signals.

2. A slot machine as claimed in claim 1, said predetermined point detecting means comprising a light shield member at said fixed point on each said reel and a light sensing means comprising a light emitting source and a light receiving element in fixed positions opposite to and spaced from each other so as to permit said light shield member to pass therebetween.

3. A slot machine as claimed in claim 2, said predetermined point detecting means comprising means for detecting a trailing edge of a signal provided by said light sensing means characteristic of the interruption of the light by said light shield member.

* * * * *